US012753999B1

(12) United States Patent
Beblo et al.

(10) Patent No.: US 12,753,999 B1
(45) **Date of Patent: *Oct. 6, 2026**

(54) ARTICULATED HEAD AND ACTUATION SYSTEM FOR A MISSILE

(71) Applicant: The Government of the United States, as represented by the Secretary of the Air Force, Wright-Patterson, OH (US)

(72) Inventors: Richard Beblo, Oakwood, OH (US); Tizoc Cruz-Gonzalez, Dayton, OH (US); Mackenzie Tidball, Beavercreek, OH (US); Gregory Reich, Bellbrook, OH (US); Benjamin Dickinson, Destin, FL (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 327 days.

This patent is subject to a terminal disclaimer.

(21) Appl. No.: 18/432,711

(22) Filed: Feb. 5, 2024

Related U.S. Application Data

(63) Continuation of application No. 17/979,835, filed on Nov. 3, 2022, now Pat. No. 11,933,587.

(60) Provisional application No. 63/287,634, filed on Dec. 9, 2021.

(51) Int. Cl.
*F42B 10/62* (2006.01)

(52) U.S. Cl.
CPC ..... *F42B 10/62* (2013.01)

(58) Field of Classification Search
CPC ..... F42B 10/62
See application file for complete search history.

(56) References Cited

U.S. PATENT DOCUMENTS

| | | | | | |
|---|---|---|---|---|---|
| 3,069,112 | A * | 12/1962 | Patterson | F42B 15/01 | 343/757 |
| 4,399,962 | A * | 8/1983 | Wedertz | F42B 10/62 | 244/3.23 |
| 4,579,298 | A * | 4/1986 | Thomson | F42B 19/005 | 244/3.21 |
| 4,925,130 | A * | 5/1990 | Kranz | F42B 10/62 | 244/3.21 |
| 6,364,248 | B1 * | 4/2002 | Spate | F42B 10/62 | 244/3.21 |
| 6,467,722 | B1 * | 10/2002 | Berry | F42B 10/62 | 244/3.21 |
| 11,009,323 | B2 * | 5/2021 | Rastegar | F42B 10/18 | |

* cited by examiner

*Primary Examiner* — Justin M Benedik
(74) *Attorney, Agent, or Firm* — AFMCLO/JAZ; Matthew D. Fair

(57) ABSTRACT

The present disclosure is directed to a missile having a main body and an articulating nosecone connected to the main body. An actuation system is operable for moving the nosecone relative to the main body via one or more electric motors and associated components. A central aperture is formed through electric motors and the associated components between the main body and the nosecone. One or more cables for transmitting electrical power, sensor data, control signals and the like extend through the central aperture between the main body and the nosecone to provide means for controlling the actuation system.

15 Claims, 7 Drawing Sheets

ARTICULATED HEAD AND ACTUATION SYSTEM FOR A MISSILE

Pursuant to 37 C.F.R. § 1.78 (a) (4), this application is a Continuation of co-pending patent application Ser. No. 17/979,835 filed Nov. 3, 2022 which claims the benefit of and priority to prior filed Provisional Application Ser. No. 63/287,634, filed Dec. 9, 2021, which is expressly incorporated herein by reference.

RIGHTS OF THE GOVERNMENT

The invention described herein may be manufactured and used by or for the Government of the United States for all governmental purposes without the payment of any royalty.

TECHNICAL FIELD

The present disclosure generally relates to a missile technology and more particularly, but not exclusively to an articulating missile head and an actuation control system.

BACKGROUND

Articulating missile heads have been analyzed and shown to theoretically improve aerodynamic drag and flight control of a missile. Prior art concepts have not worked in practice. Various designs using mechanical joints and actuation methods to achieve nosecone articulation have not been successful accordingly, there remains a need for further contributions in this area of technology.

SUMMARY

One embodiment of the present disclosure includes a unique missile that includes an articulating nosecone head. Other embodiments include apparatuses, systems, devices, hardware, methods, and combinations wherein an articulated head includes modules with central pass through apertures configured to permit one or more cables to extend through an articulated joint positioned between the head and the body of the missile. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
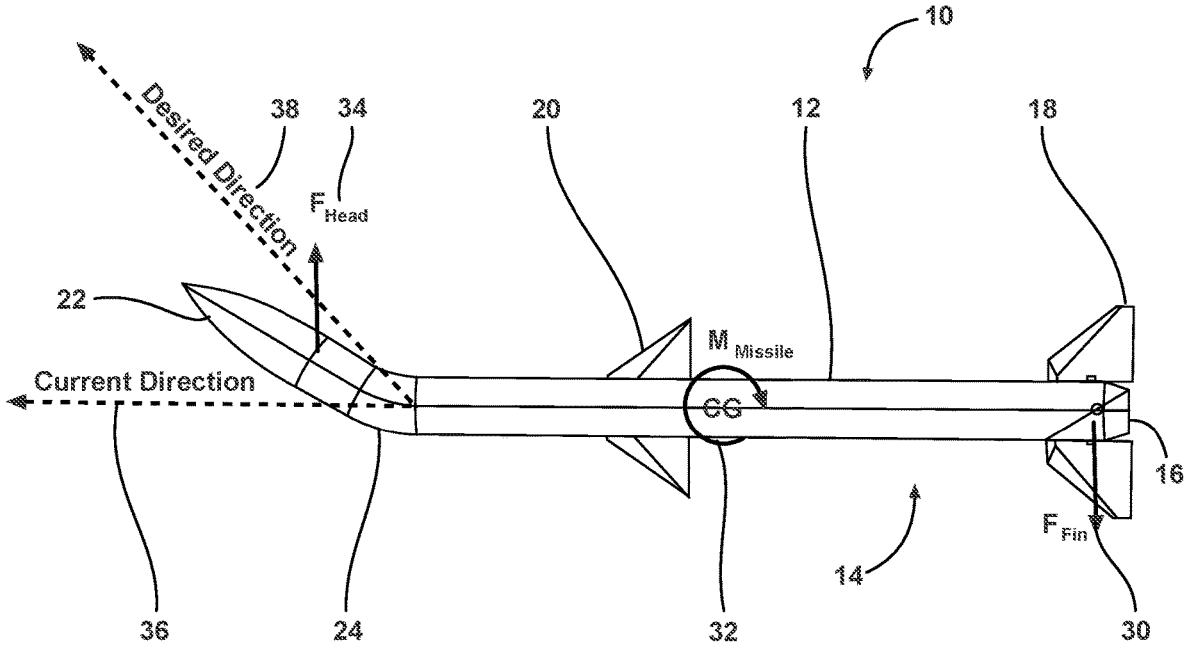
FIG. 1 is a side view of a missile with an articulating head.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

The present disclosure enables a nosecone or head of a missile to articulate, creating an angle between the centerline of the nosecone and the centerline of the body of the missile. An actuator joint aft of the nosecone is configured to permit movement of the nosecone in a desired direction relative to a centerline of the missile. The actuator joint includes ring motors or torque motors, strain wave gears or harmonic gears, and bearings arranged in a nested (concentric), semi-nested, or sequential layout connected via supporting structural elements. One or more electric motors having an axis of rotation at an angle relative to the centerline of the missile can be configured to rotate and move a nosecone to a desired angle relative to the centerline of the missile body. The one or more motors can rotate two adjoining sections relative to one another. The articulating system as described is contained within the natural outer surface contour of the missile, and during articulation does not project beyond that contour such that a smooth outer surface is maintained at all times.

In one aspect, the present disclosure includes one or more actuation sections or modules driven by a dedicated motor or driven by a single motor through gear linkages. There may also be one or more secondary motors positioned at the base of the mechanism and/or at the top of the mechanism aligned with the centerline of the missile or nosecone respectively configured to correct small angles of mis-orientation of the nosecone sometimes referred to as roll stabilization of the head. Each of the missile components incorporate a central through aperture that at least partially align to form a continuous pathway through the actuation system of the missile. These through apertures enable cabling associated with transfer of electrical power, control signals, and data signals, and the like to connect components between the missile body, the actuation modules, and the missile head. Such components include, but are not limited to CPU(s), sensors, avionics, seeker assembly, munitions, guidance and navigation components, and head articulation control systems.

Referring now to FIG. 1, a missile 10 is shown in an exemplary embodiment of the present disclosure. The missile 10 includes a main body 12 that among other things may house a propulsion system 14. The propulsion system 14 may include liquid or solid rockets or an air breathing propulsion system such as a turbojet engine. An exhaust nozzle 16 accelerates combustion products to a velocity required to move the missile 10 at a desired flight Mach number. A plurality of movable wings or control surfaces 18 may be positioned proximate the exhaust nozzle 16 to augment control of the pitch, yaw and roll of the missile 10 about the center of gravity (CG). The missile 10 may include stabilizer surfaces 20 positioned forward of the control surfaces 18. An articulating nosecone 22 is positioned at the forward end of the missile 10. The nosecone 22 may carry a payload such as an explosive device or the like. An articulating mechanism 24 is located between the nosecone 22 and the body 12. The articulating mechanism 24 will be discussed in detail below. The nosecone 22 can be moved from the current direction defined by the centerline axis 36 of the missile body 12 toward any desired azimuth or elevation, such as direction 38, via a force 34 generated by the articulation mechanism 24.

Figure 2:
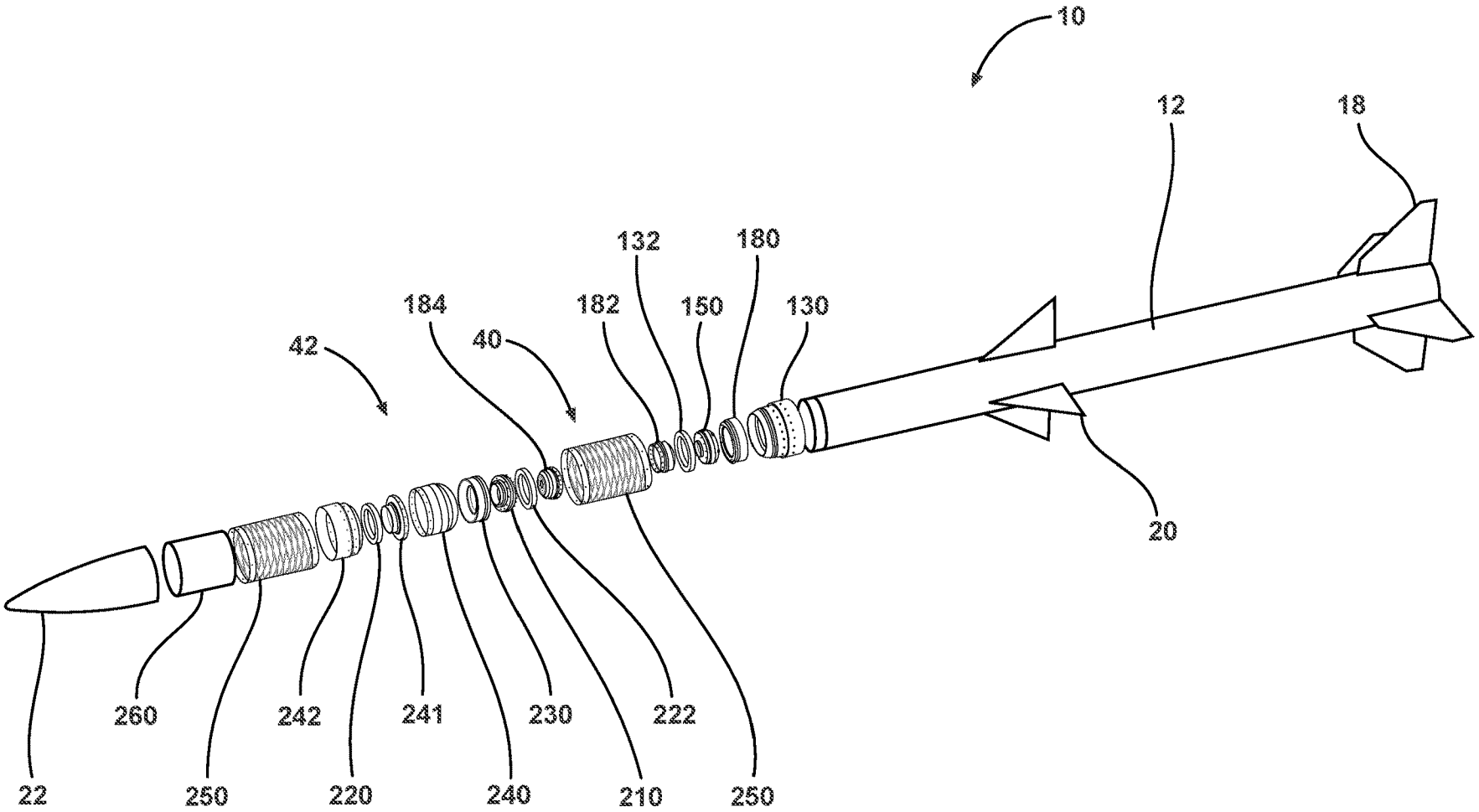
FIG. 2 is an exploded view of an actuation portion of the missile of FIG. 1.

FIG. 2 depicts a perspective view of the missile 10 with exploded components that define a body actuation module 40 and a head or nosecone actuation module 42 that generally define the articulation mechanism 24 (See FIG. 1). The body actuation module 40 includes a base interface 130 connected to the body 12 of the missile 10. A first electric motor 180 is coupled between the base interface 130 and a first strain wave gear 150. A first bearing assembly 132 rotationally supports the first electric motor such that a first knuckle 182 can be rotated to a desired angular position and thus change the angular orientation of the body actuation module relative to the centerline 36 (See FIG. 1) of the missile 10.

The head actuation module 42 includes substantially similar components to that of the body actuation module 40. A second knuckle 184 is rotationally coupled to the first knuckle 182. In one form, the first and second knuckles 182, 184 have offset center lines so that when they are rotated, the orientation angle between the body actuation module 40 and the nosecone actuation module 42 can be set to control the direction 38 (See FIG. 1) of the nosecone 22 relative to the center line 36 of the missile 10. A second bearing assembly 222 is positioned between the second knuckle 184 and a second strain wave gear 210. A second motor 230 is connected to the second knuckle 184 through the second bearing assembly 222 and the second strain wave gear 210. A head interface 240 is configured to couple the second electric motor 230 with a head bearing adaptor 241 and a third bearing assembly 220. A connecting ring 242 couples the head interface 240 with a fore body 260 which in turn is connected to the nosecone 22. An outer skin 250 can be placed around all of the components that comprise the body actuation module 40 and the nosecone actuation module 42.

Figure 3:
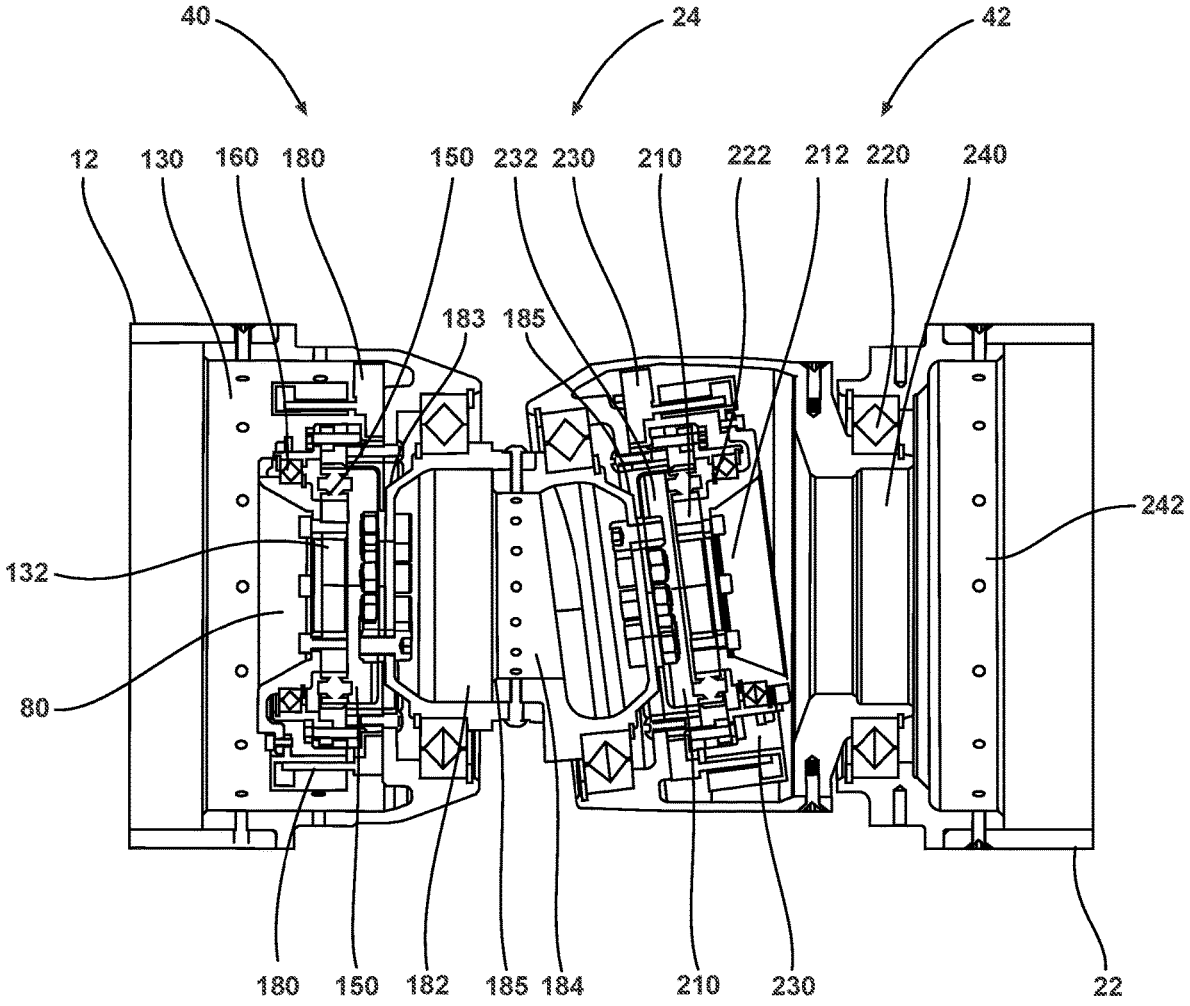
FIG. 3 is a cross sectional view of a body actuation module and a head actuation module shown in a substantially in-line orientation.
Figure 4:
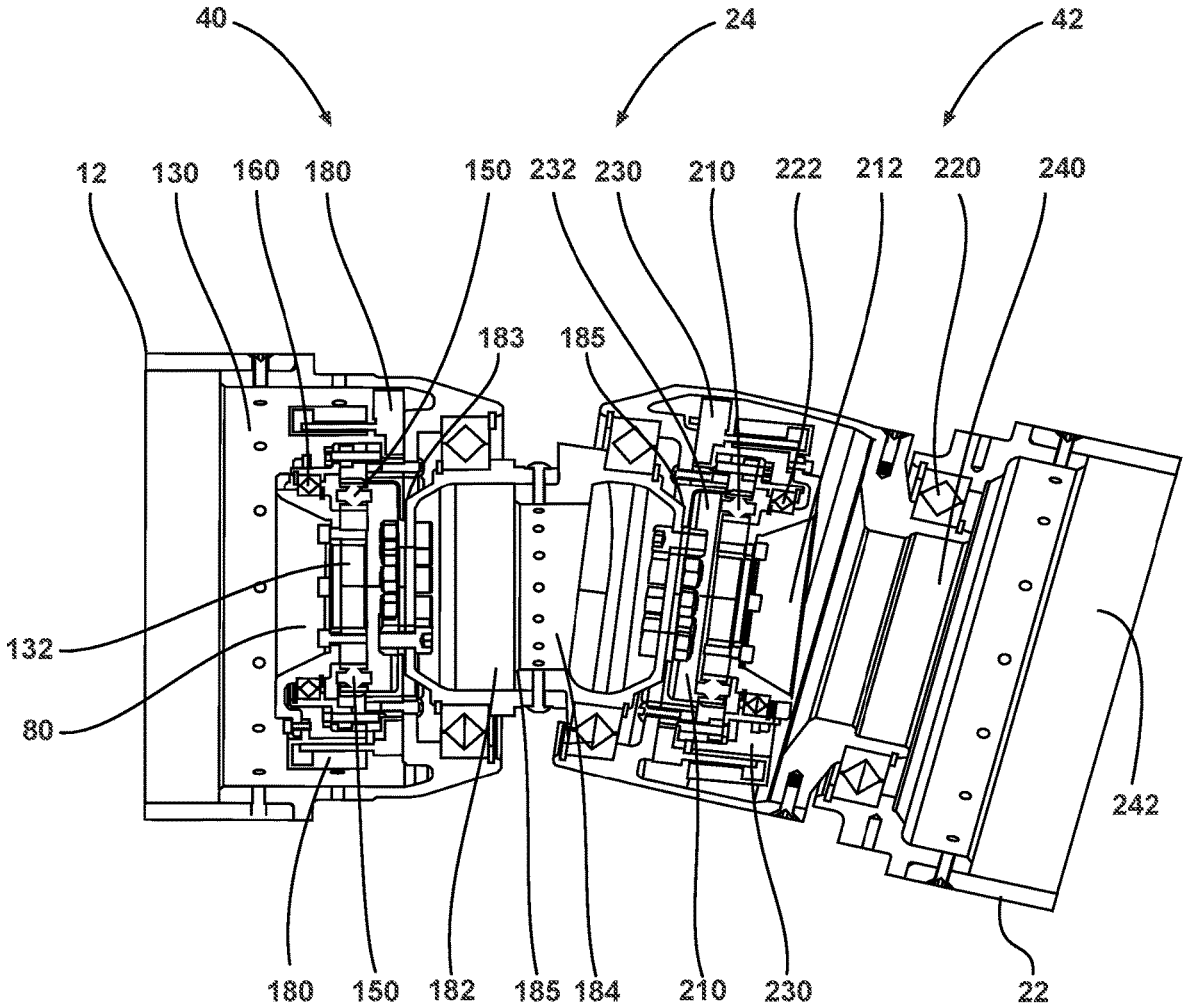
FIG. 4 is another view of FIG. 3 with the head actuation module articulated in a downward orientation.
Figure 5:
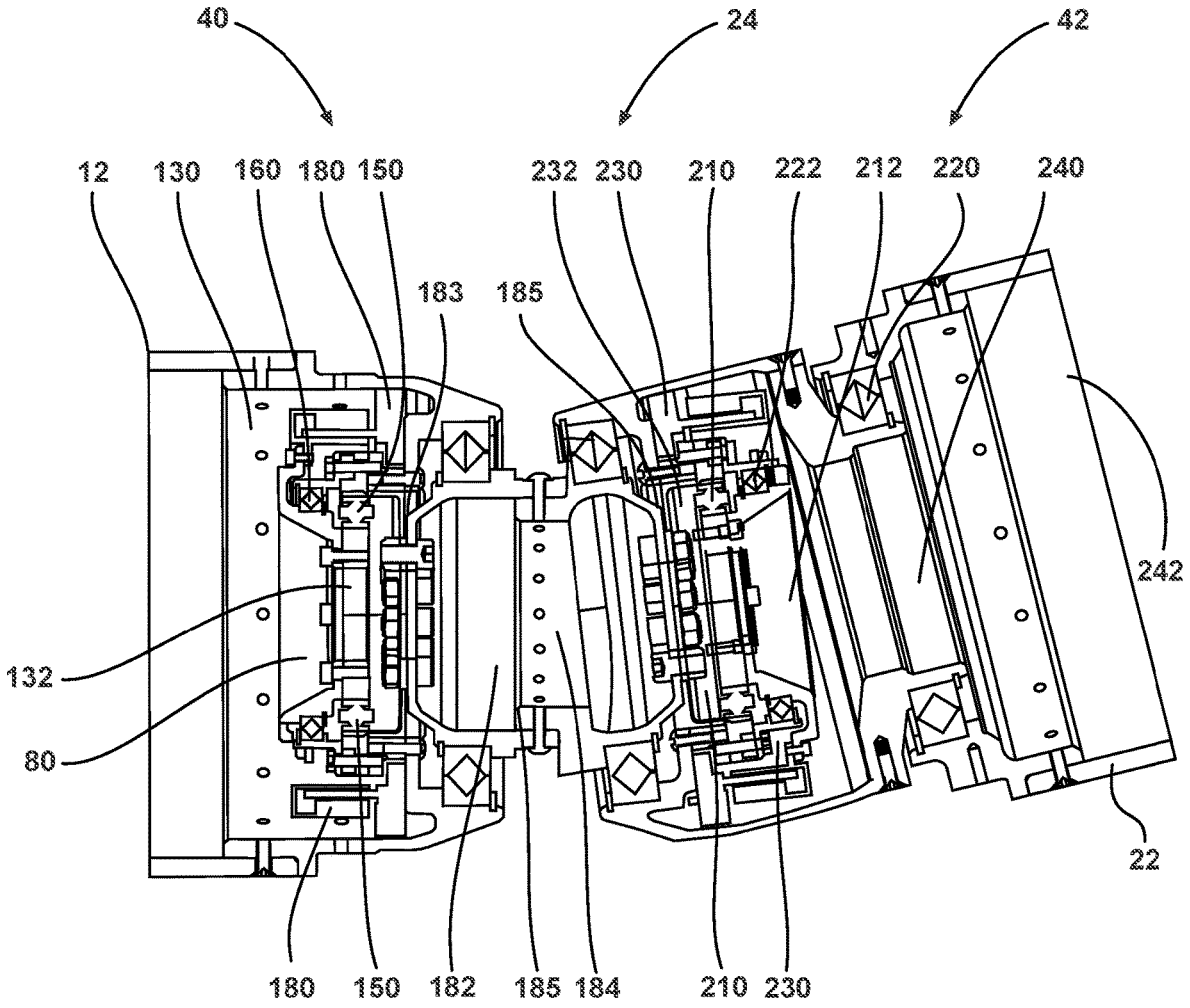
FIG. 5 is another view of FIG. 3 with the head actuation module articulated in an upward orientation.

Referring to FIGS. 3-5, exemplary sectional views of the articulating mechanism 24 are shown in a substantially straight orientation, a downward orientation and an upward configuration, respectively. The variation in angular orientation can be essentially infinite such that the articulation of the nosecone 22 can be positioned at any desired location. The articulating mechanism 24 includes a body actuation module 40 and a head actuation module 42 operably coupled together. For reference, it should be noted that the orientation of the nosecone 22 is in the opposite direction of that shown in FIGS. 1 and 2. It should be further understood that terms such as up, down, left, right, or any other orientation is relative to the drawings and should not be read as an absolute sense of positioning or location.

The body 12 is connected to one end of the body actuation module 40 and the nosecone 22 is coupled to an opposing end of the head actuation module 42. The first 182 and second 184 knuckles are operably coupled together at an interface 185. The first motor 180 is operable to rotate and cause relative motion of the first knuckle 182 relative to the base interface 130 via a strainwave gear 150.

An aft facing side 183 of the first knuckle 182 and a forward facing side 185 of the second knuckle 184 create a relative angle therebetween that the articulation mechanism moves about. The forward face 185 of second knuckle 184 rotates relative to the head interface 240 caused by the second motor 230 connected via strainwave gear 210 and a head gear mounting adapter 212. The relative motion provided by the operation of first motor 180 creates a desired relative angle and orientation between the missile body 12 and the head actuation module 42.

The second motor 230 is configured to rotate the head articulation module 42 and change the angle relative to the body actuation module 40. The second motor 230 is mounted at an angle relative to the center of rotation of the head actuation module 42 which changes an angle between the nosecone centerline and the missile centerline. Coordinated command of the first motor 180 and the second motor 230 cause the head actuation module 42 to achieve any azimuth and elevation angle combination within the operating limits of the articulating mechanism 24. The mounting angle of the second knuckle 184 determines the limits of the azimuth and elevation angle relative to the missile centerline 36.

The head interface 240 is connected to third bearing assembly 220 in order to facilitate free rotational motion of a head connecting ring 242 and the missile head 22. In some embodiments, free rotation can be eliminated by rotationally fixing the connecting ring 242 to the base interface 240, by removing the third bearing assembly 220, or by including an independently controlled third motor and gear assembly to replace the third bearing assembly 220. A skin 250 (shown in FIG. 2) may be utilized to cover all of the components of the body actuation module 40 and the head actuation module 42. The skin 250 may be used to rotationally fix the head 22 relative to the missile body 12 to provide roll stabilization of the head.

Figure 6:
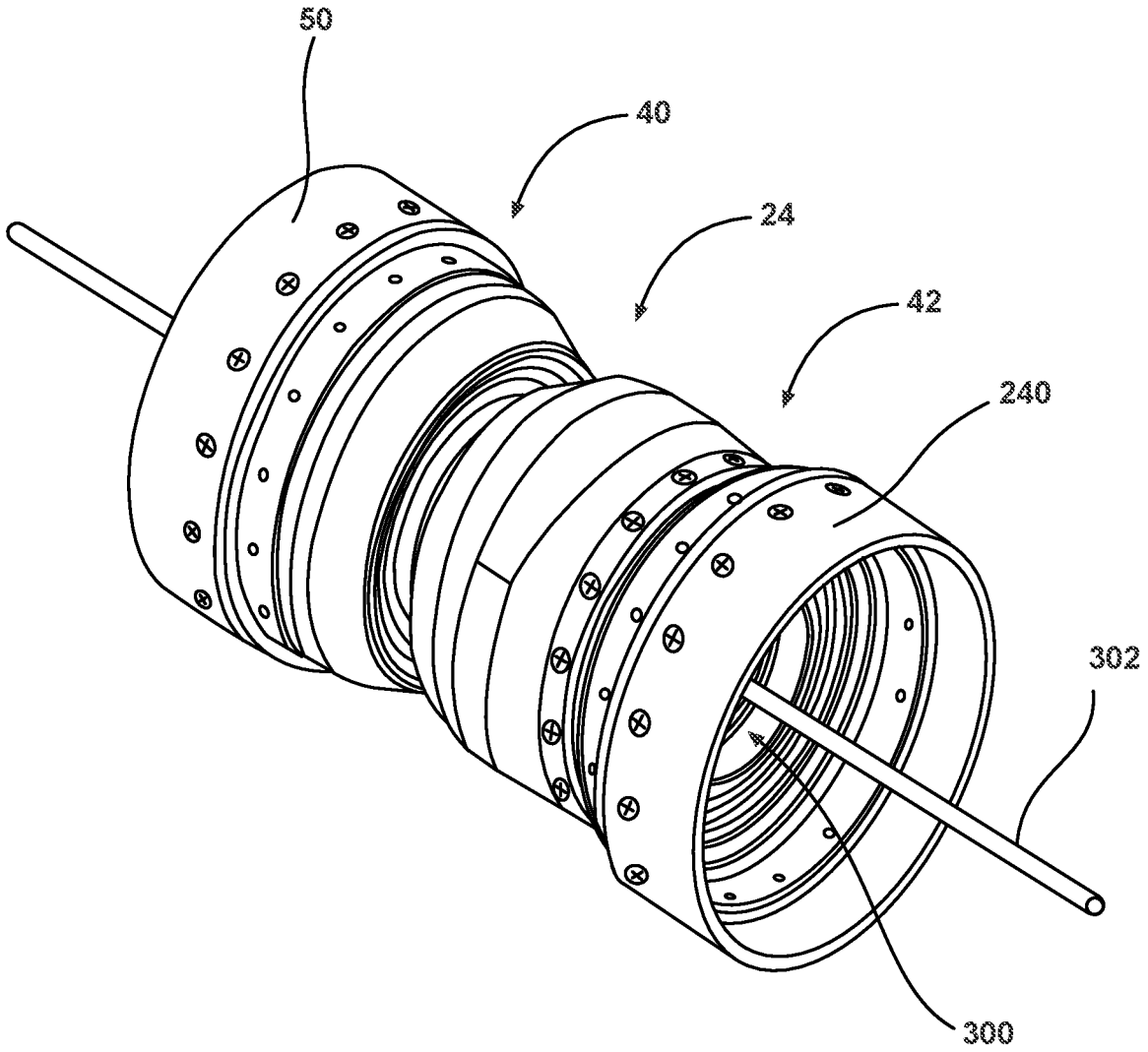
FIG. 6 is a perspective view of the body actuation module and the head actuation module with a cable passing through central apertures formed in the components that define the modules.

Referring now to FIG. 6, a perspective view of the head and body actuator modules 40, 42 is depicted. A body or base interface 50 is connectable to the body 12 (not shown) and the head interface 240 is connectable to the nosecone head 22 (not shown). A through aperture 300 is formed through a central portion of each of the components in the actuator modules 40, 42. One or more cables 302 can be positioned through the aperture 300 to provide transmission for electrical power, sensor data, control signals and the like between the nosecone 22 and the body 12 (not shown).

Figure 7:
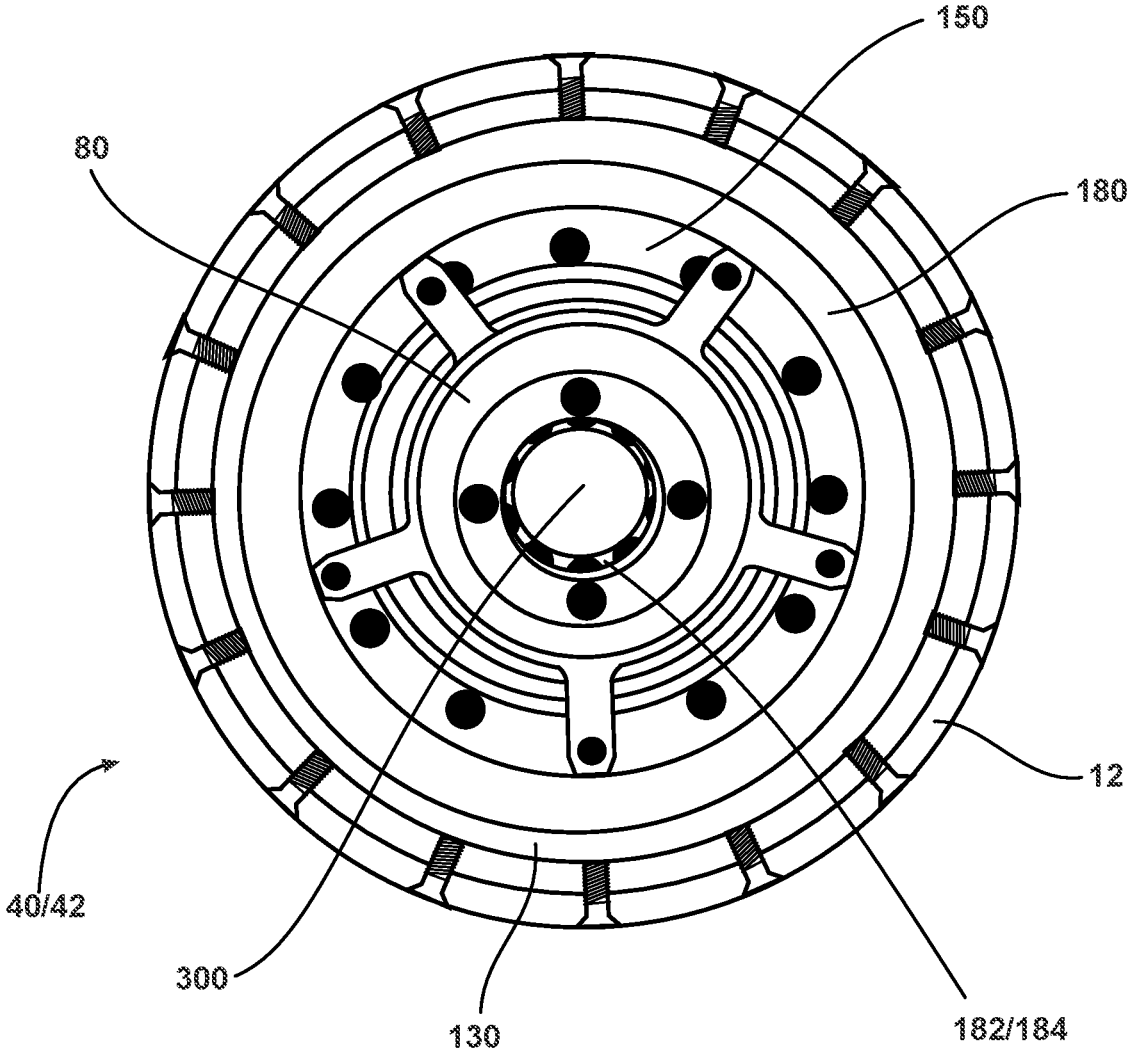
FIG. 7 is a section end view of FIG. 6 depicting the central through apertures.

An end view of the actuator modules 40, 42 is shown in FIG. 7. The first and second electric motors 180, 230, first and second base interfaces or motor mounts 130, 240, first and second gear assemblies 150, 210, the angled rotor structure defined by the first knuckle 182 and the second knuckle 184 and first and second gear mount structures 80, 212 have a central aperture 300 formed therethrough. The cable(s) 302 are free from restriction as it/they pass through the aperture 300 so that the actuator modules can move in different orientations without pulling or breaking the cable(s) 302. The cable(s) can include, but are not limited to copper wire, fiber optic lines, ribbon wire, sensor leads or other means for electrical, data or control signal transmission. In this manner, the nosecone 22 can be articulated in an unlimited number of positions without damaging the cable(s) 302.

In one aspect the present disclosure includes a missile comprising: a main body having a centerline axis; a nosecone connected to the main body; an actuation system operable for articulating the nosecone relative to the main body; and a central aperture formed through one or more components in the actuation system.

In refining aspects, the missile includes at least one cable extendable through the apertures of each component in the actuation system; wherein the cable carries at least one of electrical power, data communication, and instrumentation signals; the actuation system includes a body actuation module and a head actuation module; wherein the body actuation module includes a first electric motor for rotating components therein; wherein the head actuation module includes a second electric motor for rotating components therein; wherein the first and second electric motors cooperate to move the nosecone to a desired angular position relative to the centerline of the main body; wherein the desired angular position of the nosecone is in a direction a desired flight path; further comprising at least one secondary motor operable within the head actuation module to fine tune the angular orientation of the nosecone; further comprising an angled motor mount having a central axis positioned at an angle relative to the centerline axis of the main body; further comprising at least one strain wave gear coupled to rotatable components in the actuation system.

In another aspect, a missile comprises: a main body extending between a forward end and an aft end; one or more aerodynamic control surfaces operably coupled to the main body; a propulsion system operable to propel the missile to a desired flight Mach number; an articulating nosecone positioned at the forward end of the main body; a body actuation module and a head actuation module operably coupling the nosecone to the main body; and a plurality of central apertures formed through components in the body actuation module and the head actuation module.

In refining aspects, the missile includes first and second primary electric motors operable for rotating in the body and head actuation modules, respectively; at least one cable extending from the body to the nosecone through the central apertures formed in the body actuation module and the head actuation module; wherein the at least one cable carries electrical power, control signals, sensor signals or other data; further comprising at least one secondary electric motor operable for fine tuning a position of the articulating nosecone; and further comprising a strain wave gear, an angled motor mount, and bearing system operable in the body actuation module and the head actuation module.

In another aspect the present disclosure includes a method for operating a missile comprising: connecting an articulating nosecone to a missile body having a centerline longitudinal axis; propelling the missile along a flight path generally aligned with the centerline longitudinal axis; moving the nosecone to a desired angle away from centerline axis; maneuvering the flight path of the missile in a different direction generally aligned with a longitudinal axis of the nosecone; and transmitting control signals, electrical power, other data signals through one or more lines extending through a central aperture formed in actuation components positioned between the missile body and the nosecone.

In refining aspects, the method comprises rotating components with one or more electric motors to change the angle of the nosecone relative to the body of the missile; and controlling a position of the nosecone with two primary electric motors formed with internal through apertures in a primary actuation system; and fine tuning the position of the nosecone with a secondary motor actuation system.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A missile comprising:
- a main body having a centerline axis;
- a nosecone connected to the main body;
- an actuation system operable for articulating the nosecone relative to the main body; and
- a central aperture formed through one or more components in the actuation system;
- wherein the actuation system includes a body actuation module and a head actuation module;
- a first electric motor operable for rotating components in the body actuation module;
- a second electric motor operable for rotating components in the head actuation module; and
- a central through aperture formed along a rotational axis of the first and second electric motors.

2. The missile of claim 1, further comprising at least one cable extendable through the apertures of the first and second electric motors in the actuation system.

3. The missile of claim 2, wherein the cable carries at least one of electrical power, data communication, and instrumentation signals.

4. The missile of claim 1, wherein the first and second electric motors cooperate to move the nosecone to a desired angular position relative to the centerline of the main body.

5. The missile of claim 4, wherein the desired angular position of the nosecone is in a direction a desired flight path.

6. The missile of claim 4, further comprising at least one secondary motor operable within the head actuation module to fine tune the angular orientation of the nosecone.

7. The missile of claim 1, further comprising an angled motor mount having a central axis positioned at an angle relative to the centerline axis of the main body.

8. The missile of claim 1, further comprising at least one strain wave gear coupled to rotatable components in the actuation system.

9. A missile comprising:
- a main body extending between a forward end and an aft end;
- one or more aerodynamic control surfaces operably coupled to the main body;
- a propulsion system operable to propel the missile to a desired flight Mach number;
- an articulating nosecone positioned at the forward end of the main body;
- a body actuation module and a head actuation module operably coupling the nosecone to the main body; and
- a plurality of central apertures formed through components in the body actuation module and the head actuation module; and
- a strain wave gear, an angled motor mount, and bearing system operable in the body actuation module and the head actuation module.

10. The missile of claim 9, further comprising first and second primary electric motors operable for rotating in the body and head actuation modules, respectively.

11. The missile of claim 9, further comprising at least one cable extending from the body to the nosecone through the central apertures formed in the body actuation module and the head actuation module.

12. The missile of claim 9, wherein the at least one cable carries electrical power, control signals, sensor signals or other data.

13. The missile of claim 9, further comprising at least one secondary electric motor operable for fine tuning a position of the articulating nosecone.

14. A method for operating a missile comprising:

connecting an articulating nosecone to a missile body having a centerline longitudinal axis;

propelling the missile along a flight path generally aligned with the centerline longitudinal axis;

moving the nosecone to a desired angle away from centerline axis;

maneuvering the flight path of the missile in a different direction generally aligned with a longitudinal axis of the nosecone;

rotating components with one or more electric motors to change the angle of the nosecone relative to the body of the missile; and transmitting control signals, electrical power, other data signals through one or more lines extending through a central aperture formed around a rotational axis of the one or more electric motors positioned between the missile body and the nosecone.

15. The method of claim 14, further comprising:

controlling a position of the nosecone with two primary electric motors formed with internal through apertures in a primary actuation system; and fine tuning the position of the nosecone with a secondary motor actuation system.

* * * * *